US005080776A

United States Patent [19]

Partridge et al.

[11] Patent Number: 5,080,776

[45] Date of Patent: Jan. 14, 1992

[54] HYDROGEN-BALANCED CONVERSION OF DIAMONDOID-CONTAINING WASH OILS TO GASOLINE

[75] Inventors: Randall D. Partridge, W. Trenton; D. Duayne Whitehurst, Titusville, both of N.J.

[73] Assignee: Mobil Oil Corporation, Fairfax, Va.

[21] Appl. No.: 543,933

[22] Filed: Jun. 14, 1990

[51] Int. Cl.[5] ..... C10G 69/02

[52] U.S. Cl. ..... 208/60; 208/100

[58] Field of Search ..... 208/60, 100

[56] References Cited

U.S. PATENT DOCUMENTS 3,914,171 10/1975 Hans-Juergen Schoennagel ..... 208/135

4,551,228 11/1985 Ramella et al. ..... 208/65

4,812,223 3/1989 Hickey, Jr. et al. ..... 208/111

4,820,402 4/1989 Partridge et al. ..... 208/111

OTHER PUBLICATIONS

Schwarzenbek, "Catalytic Reforming", Origin and Refining of Petroleum (1971).

*Primary Examiner*—Curtis R. David

*Assistant Examiner*—William C. Diemler

*Attorney, Agent, or Firm*—Alexander J. McKillop; Charles J. Speciale; Robert B. Furr, Jr.

[57] ABSTRACT

A two-stage method is provided for converting diamondoid-containing wash oils to gasoline comprising a first hydrocracking stage and a second reforming stage. In the most preferred embodiment, process conditions are controlled to effect a substantially hydrogen-balanced conversion of diamondoid-containing solvent to a motor gasoline blending component.

21 Claims, 2 Drawing Sheets

HYDROGEN-BALANCED CONVERSION OF DIAMONDOID-CONTAINING WASH OILS TO GASOLINE

FIELD OF THE INVENTION

The present invention relates to upgrading diamondoid-containing hydrocarbon solvent streams evolved from the extraction of diamondoid compounds from a natural gas stream. The invention also relates to the disposal of liquid hazardous waste streams produced from such diamondoid extraction processes.

BACKGROUND OF THE INVENTION

Natural gas production may be complicated by the presence of certain heavy hydrocarbons in the subterranean formation in which the gas is found. Under conditions prevailing in the subterranean reservoirs, the heavy hydrocarbons may be partially dissolved in the compressed gas or finely divided in a liquid phase. The decrease in temperature and pressure attendant to the upward flow of gas as it is produced to the surface results in the separation of solid hydrocarbonaceous material from the gas. Such solid hydrocarbons may form in certain critical places such as on the interior wall of the production string, thus restricting or actually plugging the flow passageway.

Many hydrocarbonaceous mineral streams contain some small proportion of these diamondoid compounds. These high boiling, saturated, three-dimensional polycyclic organics are illustrated by adamantane, diamantane, triamantane and various side chain substituted homologues, particularly the methyl derivatives. Diamondoid compounds have high melting points and high vapor pressures for their molecular weights and have recently been found to cause problems during production and refining of hydrocarbonaceous minerals, particularly natural gas, by condensing out and solidifying, thereby clogging pipes and other pieces of equipment. For a survey of the chemistry of diamondoid compounds, see Fort, Jr., Raymond C., *The Chemistry of Diamond Molecules*, Marcel Dekker, 1976.

In recent times, new sources of hydrocarbon minerals have been brought into production which, for some unknown reason, have substantially larger concentrations of diamondoid compounds. Whereas in the past, the amount of diamondoid compounds has been too small to cause operational problems such as production cooler plugging, now these compounds represent both a larger problem and a larger opportunity. The presence of diamondoid compounds in natural gas has been found to cause plugging in the process equipment requiring costly maintenance downtime to remove. On the other hand, these very compounds which can deleteriously affect the profitability of natural gas production are themselves valuable products.

Various processes have been developed to prevent the formation of such precipitates or to remove them once they have formed. These include mechanical removal of the deposits and the batchwise or continuous injection of a suitable solvent. Recovery of one such class of heavy hydrocarbons, i.e. diamondoid materials, from natural gas is detailed in commonly assigned copending U.S. Pat. Application Ser. No. 405,119, filed Sept. 7, 1989, which is a continuation of U.S. Pat. No. 358,758, filed May 26, 1989, now abandoned, as well as U.S. Pat. Applications Ser. Nos. 358,759; 358,760; and U.S. Pat. Nos. 4,952,747; 4,952,747; 4,952,749; and 4,982,049; 358,761, all filed May 26, 1989. The text of these U.S. Patent Applications is incorporated herein by reference.

Research efforts have more recently been focused on separating diamondoid compounds from the liquid solvent stream described, for example, in the above cited U.S. Pat. Application No. 405,119 U.S. Pat. No. 4,952,748. The diamondoid and solvent components have proven difficult to separate via conventional multistaqe distillation due at least in part to the overlapping boiling ranges of the preferred solvents and the commonly occurring diamondoid compounds. Further, the diamondoid compounds have been found to deposit precipitate in the overhead condenser circuit of a solvent distillation apparatus. Thus researchers have concentrated efforts both on separating the diamondoid compounds from the solvent as well as on utilizing the separated diamondoid materials.

Solvent injection has been found to be essential to produce natural gas economically from wells containing substantial diamondoid concentrations. The resulting diamondoid-enriched solvent may be processed to recover the diamondoid materials if suitable processing equipment is available, and if the market demand for diamondoids provides the economic incentive. However, the geographic location of the diamondoid-producing wells or other factors such as weak market demand, may render diamondoid recovery from the enriched solvent stream uneconomical.

The diamondoid-enriched solvent may be sold by blending the mixture into a heavier fuel such as No. 4 fuel oil or a heavier industrial steam boiler grade fuel oil, such as bunker fuel, assuming that the diamondoid materials could be diluted sufficiently to avoid the deposition of crystalline solids in the fuel oil handling equipment.

The most desirable solvent for recovering diamondoid materials from natural gas would be a light kerosene or diesel fuel. Blending diesel fuel or light kerosene into heavy fuel oil would downgrade the value of the light distillate solvent to that of the heavy fuel oil. Thus, a relatively expensive solvent mixture would be undesirably downgraded and sold as a less valuable fraction. On the other hand, increasingly stringent waste disposal regulations could require that the enriched solvent be handled as a hazardous waste, further restricting the disposition of the enriched solvent.

Thus it would be highly beneficial to provide an integrated process for converting the diamondoid-enriched solvent stream into a readily saleable product. Further, it would be desirable to convert the enriched solvent stream to a more valuable product such as motor gasoline. Still further, it would be desirable to convert the enriched solvent in an integrated process which is compatible with the utilities available at natural gas processing facilities.

SUMMARY OF THE INVENTION

The present process provides a substantially hydrogen-balanced method for upgrading a diamondoid-containing hydrocarbon solvent to a motor gasoline blending stock by first hydrocracking the diamondoid-containing hydrocarbon solvent under relatively mild conditions in the presence of a catalyst having pores of sufficient size to admit the diamondoid molecules. This first hydrocracking stage is closely controlled to provide sufficient severity to crack diamondoid compounds to alkyl-substituted cyclohexanes and a mixture of normal and branched alkanes. This mixture has been found to be an ideal reforming feedstock and readily converts to form a motor fuel blending component.

Further, it has surprisingly been found that this coupled hydrocrackinq/reforming process for upgrading diamondoid-containing hydrocarbon solvents is substantially hydrogen balanced and may be controlled to require no external source of hydrogen.

The invention further provides a method for disposing of a hydrocarbon liquid hazardous waste material containing diamondoid compounds by converting the hazardous stream into motor gasoline suitable for resale.

The process of the present invention achieves these and other objectives by an integrated method for upgrading a diamondoid-containing hydrocarbon solvent comprising the steps of:

(a) providing a hydrocrackable hydrocarbon solvent mixture containing normal or slightly branched paraffins having dissolved therein at least one diamondoid compound selected from the group consisting of adamantane, alkyl-substituted adamantane, diamantane, alkyl-substituted diamantane, triamantane, and alkyl-substituted triamantane;

(b) contacting said hydrocarbon solvent mixture of step (a) with a catalyst having a Constraint Index of less than about 1 in a primary reaction zone under controlled hydrocracking conditions including hydrogen pressure selected to convert at least a portion of diamondoid compounds contained therein to alkyl substituted cyclohexanes;

(c) withdrawing a hydrocracked intermediate product from said primary reaction zone of step (b);

(d) contacting said hydrocracked intermediate product in a secondary reaction zone with a reforming catalyst comprising a Group VIIIA metal under reforming conditions selected to evolve molecular hydrogen and to convert at least a portion of said alkyl substituted cyclohexane to substituted aromatics;

(e) recycling a first portion of said molecular hydrogen produced in said secondary reaction zone of step (d) to said primary reaction zone of step (b); and (f) recycling a second portion of said molecular hydrogen to said secondary reaction zone of step (d) to maintain the hydrogen partial pressure required for reforming said hydrocracked intermediate product to motor gasoline blending stock.

DETAILED DESCRIPTION

Feedstocks

Figure 1:
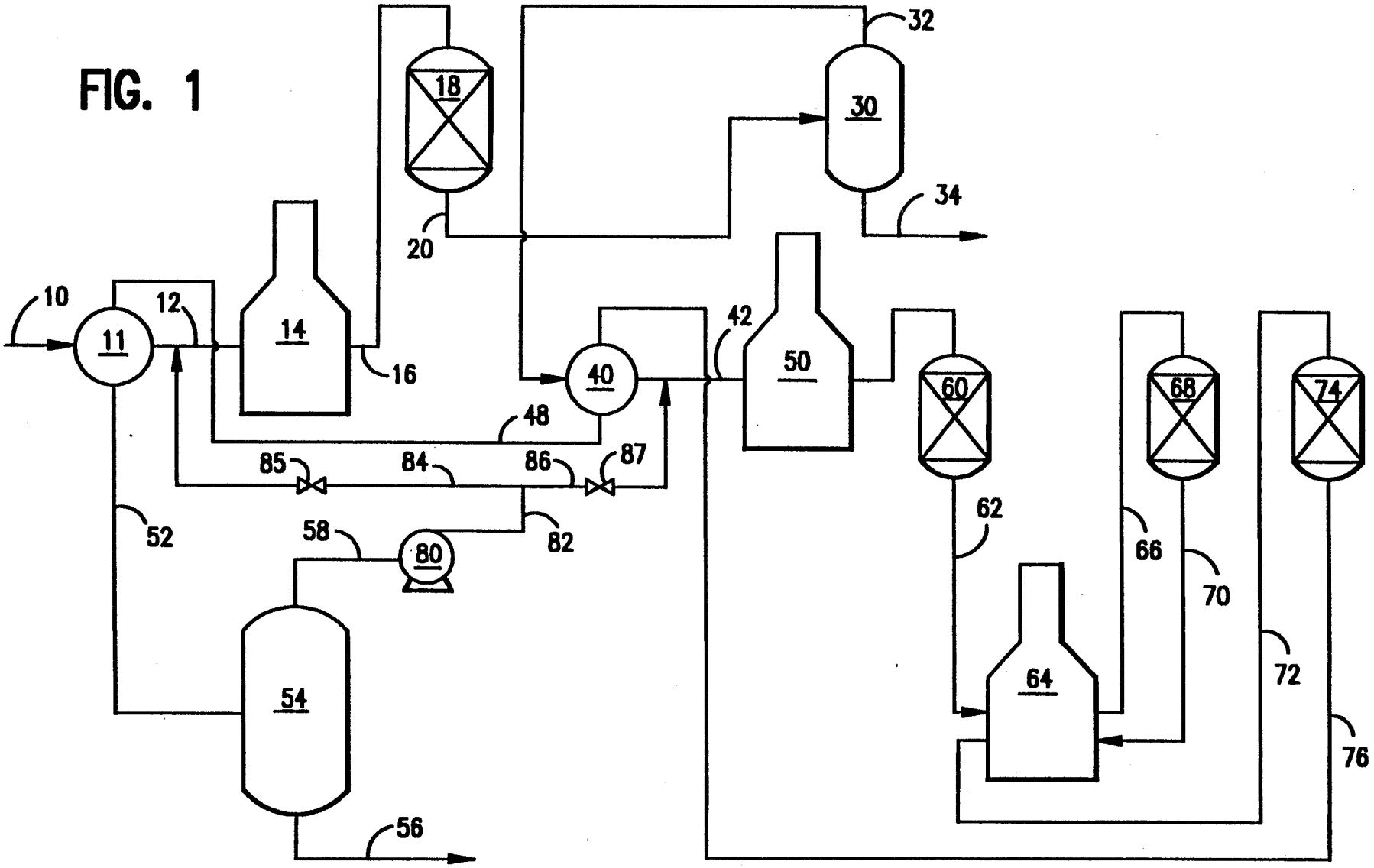
FIG. 1 is a simplified schematic showing the major processing steps in the integrated process of the present invention.

The feedstocks useful in the present invention generally contain two components, with the first component comprising diamondoid materials and the second component comprising a hydrocarbon solvent.

The first member of the diamondoid family of molecules is adamantane. Adamantane, tricyclo-[3.3.3.1$^{3,7}$]decane, is a polycyclic alkane with the structure of three fused cyclohexane rings. The ten carbon atoms which define the framework structure of adamantane are arranged in an essentially strainless manner. For a general survey of the chemistry of diamondoid molecules, see *Adamantane, The Chemistry of Diamond Molecules.* Raymond C. Fort, Marcel Dekker, New York, 1976.

Adamantane is the smallest member of the group referred to herein as diamondoid molecules. It has been found, in accordance with the present invention, that diamondoid molecules may be selectively hydrocracked to form alkyl-substituted cyclohexanes, which may be further reacted to form alkyl-substituted aromatics.

The second component in the feedstock is the hydrocarbon solvent. This solvent may comprise any mixture of paraffins, olefins, naphthenes, and aromatics which readily dissolves the diamondoid component and is preferably a petroleum distillate fraction boiling within the range of from about 50° to about 300° C. (120° to 572° F.). Useful solvents include naphtha outs having boiling ranges of from about 150° C. to about 205° C. (302° to 401° F.) as well as kerosene cuts having boiling ranges of from about 180° C. to about 300° C. (356° to 572° F.).

Low sulfur feeds tend to prolong the active life of the catalysts useful in the hydrocracking and reforming stages of the present process, and consequently are most preferred. These solvents include the lighter grades of diesel fuel such as ASTM D975-67 No. 1D diesel fuel which meets a 550° F. 90% point and a 0.5 weight % maximum sulfur specification, and ASTM D975-67 No. 2 diesel fuel which meets a 640° F. 90% point and a 0.7 weight % maximum sulfur specification. Suitable solvents also include ASTM D396-67 No. 1 and No. 2 fuel oils which meet 90% point specifications of 550° F. and 640° F. and maximum sulfur specifications of 0.5 and 0.7 weight %, respectively. Preferred solvents include gas oils such as straight run distillates and FCC light cycle oils which will be beneficially upgraded in the process of the present invention.

The Hydrocracking Stage

The purpose of the hydrocracking stage is to convert the diamondoid component of the feedstock into a cycloalkane which is readily converted to an octane-enhancing substituted aromatic in the subsequent reforming stage. Surprisingly, it has been found that this conversion may be controlled to convert naturally occurring diamondoid compounds, e.g., adamantane, into alkyl substituted cyclohexane, and that the hydrogen consumed in this conversion step is substantially equal to that produced by the dehydrogenation of the alkyl substituted cyclohexane in the downstream reforming stage. The higher adamantalogs such as diamantane have also been found to convert. While not presented to limit the scope of the invention by a recitation of theory, one illustrative reaction for the conversion of admantane to trimethylbenzene, a valuable gasoline blending component, is illustrated below with reference to 1,3,5-trimethylbenzene:

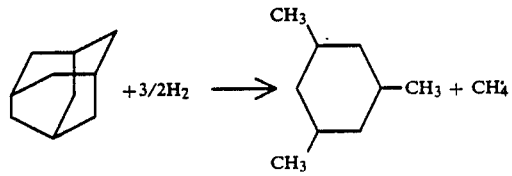

-continued

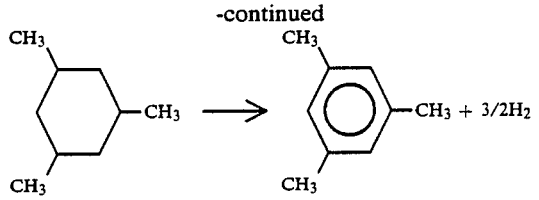

Still further, the hydrocracking process is exothermic and is commonly controlled with a cold hydrogen quench in industrial practice. However, the hydrocracking exotherm is highly desirable in the present invention as the hydrocracked intermediate product is used as feedstock for the endothermic reforming stage.

Suitable hydrocracking catalysts include those solids having relatively large pores which exhibit both acid and hydrogenation functions. The large pore size is critical for the conversion of diamondoid materials and is believed to enable the large polycyclic diamondoid molecules to access the internal pore structure of the solid catalyst where the controlled cracking reaction proceeds. Less specific cracking attributable to contact between the surface active sites and the diamondoid molecules is essentially unavoidable, but this accounts for only a relatively minor yield loss as the vast majority of active sites are within the catalyst pores and comparatively few active sites are present on the exposed surface of the catalyst particles.

The acid function is therefore suitably provided either by a large pore, amorphous material such as alumina, silica-alumina, or silica, or by a large pore size aluminosilicate zeolite characterized by a Constraint Index of less than about 1, examples of which include mordenite, zeolite X, zeolite Y, ZSM-3, ZSM-18, or ZSM-20. The zeolites may be used in their various forms, for example, their cationic forms, preferably cationic forms of enhanced hydrothermal stability to resist the irreversible loss of the acid function upon exposure to the relatively severe hydrothermal conditions attendant to hydrocracking. For this reason, rare earth exchanged large pore zeolites such as REX and REY are preferred, as are ultra-stable zeolte Y (USY) and high silica zeolites such as dealuminized Y or dealuminized mordenite.

Zeolite ZSM-3 is taught in U.S. Pat. No. 3,415,736; zeolite ZSM-18 is taught in U.S. Pat. No. 3,950,496 and zeolite ZSM-20 is taught in U.S. Pat. No. 3,972,983. Each of these patents is incorporated by reference as if set forth at length herein for the details of the synthesis and properties of the respective zeolites.

Zeolite Beta which behaves as a large-pore or medium-pore zeolite under different process condition is also useful in the hydrocracking process of the present invention and is taught in U.S. Pat. Nos. 4,696,732; 3,308,069, as well as Re. 28,341, the entire contents of which are incorporated by reference as if set forth at length herein.

A convenient measure of the extent to which a zeolite provides control to molecules of varying sizes to its internal structure is the Constraint Index of the zeolite. The method by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as if set forth at length herein.

Constraint Index (CI) values for some typical materials are shown below in Table A.

TABLE A

| | CI (at test temperature) |
|---|---|
| ZSM-4 | 0.5 (316° C.) |
| ZSM-5 | 6-8.3 (371° C.-316° C.) |
| ZSM-11 | 5-8.7 (371° C.-316° C.) |
| ZSM-12 | 2.3 (316° C.) |
| ZSM-20 | 0.5 (371° C.) |
| ZSM-22 | 7.3 (427° C.) |
| ZSM-23 | 9.1 (427° C.) |
| ZSM-34 | 50 (371° C.) |
| ZSM-35 | 4.5 (454° C.) |
| ZSM-38 | 2 (510° C.) |
| ZSM-48 | 3.5 (538° C.) |
| ZSM-50 | 2.1 (427° C.) |
| TMA Offretite | 3.7 (316° C.) |
| TEA Mordenite | 0.4 (316° C.) |
| Clinoptilolite | 3.4 (510° C.) |
| Mordenite | 0.5 (316° C.) |
| REY | 0.4 (316° C.) |
| Amorphous Silica-alumina | 0.6 (538° C.) |
| Dealuminized Y | 0.5 (510° C.) |
| Erionite | 38 (316° C.) |
| Zeolite Beta | 0.6-2.0 (316° C.-399° C.) |

The above-described Constraint Index provides a definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operations (conversion) and the presence or absence of binders. Likewise, other variables, such as crystal size of the zeolite, the presence of occluded contaminants, etc., may affect the Constraint Index. Therefore, it will be appreciated that it may be possible to so select test conditions, e.g. temperature, as to establish more than one value for the Constraint Index of a particular zeolite. This explains the range of Constraint Indices for some zeolites, such as ZSM-5, ZSM-11 and Beta.

It is to be realized that the above CI values typically characterize the specified zeolites, but that such are the cumulative result of several variables useful in the determination and calculation thereof. Thus, for a given zeolite exhibiting a CI value within the range of 1 to 12, depending on the temperature employed during the test method within the range of 290° C. to about 538° C., with accompanying conversion between 10% and 60%, the CI may vary within the indicated range of 1 to 12. Likewise, other variables such as the crystal size of the zeolite, the presence of possibly occluded contaminants and binders intimately combined with the zeolite may affect the CI. It will accordingly be understood to those skilled in the art that the CI, as utilized herein, while affording a highly useful means for characterizing the zeolites of interest is approximate, taking into consideration the manner of its determination, with the possibility, in some instances, of compounding variable extremes. The hydrogenation function is provided by a metal or combination of metals. Noble metals of Group VIIIA of the Periodic Table, especially platinum or palladium may be used, as may base metals of Groups IVA, VIA and VIIIA, expecially chromium, molybdenum, tungsten, cobalt and nickel. Combinations of metals such as nickel-molybdenum, cobalt-molybdenum, cobalt-nickel, nickel-tungsten, cobalt-nickel-molybdenum, and nickel-tungsten-titanium have also been shown to be effective.

In practicing conversion processes using the catalyst of the present invention, it may be useful to incorporate the above-described crystalline zeolites with a matrix comprising another material resistant to the temperature and other conditions employed in such processes. Such matrix materials include synthetic or naturally occurring substances as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constitutent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-beryllia, and silica-titania, as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix, on an anhydrous basis, may vary widely with the zeolite content ranging from between about 1 to about 99 percent by weight and more usually in the range of about 5 to about 80 percent by weight of the dry composite.

Additional catalyst modifying procedures which may also optionally be employed to modify catalyst activity or selectivity include precoking and presteaming (e.g., before oxide incorporation), or combinations thereof.

The process conditions for the hydrocracking stage are preferably mild conditions of temperature, space velocity and hydrogen pressure sufficient to open enough of the cyclohexane rings in the diamondoid constituent of the feedstock to provide an intermediate product rich in alkyl-substituted cyclohexane, without overcracking the diamondoids to $C_4$- light aliphatic gases. Broad and preferred ranges for such process conditions are shown below in Table B.

TABLE B

HYDROCRACKING PROCESS CONDITIONS FOR CONTROLLED CRACKING OF DIAMONDOIDS TO REFORMER FEEDSTOCK

| | | |
|---|---|---|
| Temperature | Broad: | 400 to 850° F. (205 to 455° C.) |
| | Preferred: | 550 to 750° F. (285 to 390° C.) |
| Pressure | Broad: | 400 to 2000 psig (2860 to 13,890 kPa) |
| | Preferred: | 800 to 1500 psig (5620 to 10,440 kPa) |
| Hydrogen dosage: | Broad: | 1000 to 10,000 SCF/BBL liquid feed |
| | Preferred: | 2000 to 6000 SCF/BBL liquid feed |
| Weight Hourly Space Velocity | Broad: | 0.1 to 10 $hr^{-1}$ |
| | Preferred: | 0.5 to 4 $hr^{-1}$ |

The Reforming Stage

The general object of a reforming process is to crack long chain paraffins, isomerize normal paraffins to isoparaffins, dehydrocyclize normal and slightly branched paraffins to aromatics, and to dehydrogenate cycloparaffins to aromatics. The reforming stage of the present process performs each of these reaction steps, although in a preferred embodiment, process conditions in the hydrocracking stage are controlled such that the boiling range of the intermediate product stream from the hydrocracking stage which forms the reforming stage feedstream contains only a minor proportion of long-chain paraffins which would require further cracking to form a gasoline blending component.

For a general survey of suitable reforming catalysts and process conditions, see Schwarzenbek, "Catalytic Reforming" in *Origin and Refining of Petroleum* 94 (R.F. Gould, ed., 1971), as well as U.S. Pat. Nos. 3,914,171 to Schoennagel and U.S. Pat. No. 4,551,228 to Ramilla et al., which patents are incorporated herein by reference.

In the reforming reactor of the present method, the reactant stream comprising hydrogen and the diamondoid-containing hydrocarbon solvent is sequentially contacted with the catalyst beds maintained under temperature, pressure, and space velocity conditions particularly selected for effecting conversion of the diamondoid-derived alkyl substituted cyclohexane molecules to substituted aromatics as well as the dehydrogenation, hydrogenation, dehydrocyclization or isomerization of the remaining constitutents comprising the hydrocracking intermediate product stream. Product gases may be recycled. The reformer feedstock produced by the hydrocracking stage readily converts to a high octane reformate and process conditions are typically set to provide sufficient hydrogen gas for the hydrocracking stage, rather than to attain a target octane. This contrasts with common operating practice in the petroleum refining industry in which reaction severity is controlled to meet a minimum reformate octane level.

Total Recycle Ratios (TRR), i.e. moles of recycle gas/moles of hydrocarbon charge, may range from about 5 to 12. The reforming temperatures employed are usually selected from within the range of 454° C. up to about 549° C. (850° up to about 1020° F.). The reforming pressure may be selected over a relatively wide range from as low as about 50 psig up to about 1,000 psig. However, it is preferred to effect the reforming operation at a pressure selected from within the range of about 100 to about 400 psig. Pressures below 350 psig are particularly advantageous as is well known at this stage of the art. Liquid hourly space velocity, on the other hand, may vary considerably depending upon temperature and pressure conditions selected to optimize the severity of the operation and this may fall within the range of 0.1 up to about 10, but more usually is selected from within the range of about 1-5 LHSV.

Suitable catalysts for reforming reactions include small crystallites of platinum, platinum group metals, or platinum alloys supported on alumina base. The alumina base may be gamma, eta or other structures. The catalysts may contain platinum only or platinum with other metals such as rhenium, iridium, tin, etc., whether in the bi-metallic or multi-metallic forms.

Process Flow

Referring now to FIG. 1, a diamondoid-containing hydrocarbon feedstock flows through line 10 to feed- /effluent heat exchanger 11, which is schematically shown as one heat exchange unit but may more typically comprise two or more banks of three or more shell and tube heat exchangers. The preheated feedstock is withdrawn from heat exchanger 11 through line 12 where it is mixed with hydrogen-rich circulation gas from line 84. The mixture of feedstock and hydrogen-rich gas then enters the hydrocracker process furnace 14 where it is heated to hydrocracking conversion temperature and flows through line 16 to the inlet of hydrocracking reactor vessel 18 which contains a hydrocracking catalyst as described above. The hydrocracking reactor vessel may optionally include a quench gas inlet nozzle (not shown) for injecting a cold hydrogen-rich quench gas to control the temperature of the exothermic hydrocracking reaction.

The hydrocracked intermediate product containing alkyl substituted cyclohexane derived from hydrocracked adamantane is withdrawn from hydrocracking reactor vessel 18 and is charged through line 20 to fractionator 30 which splits the hydrocracking reactor effluent into an overhead reformer feedstream and a heavy hydrocracker effluent bottom stream. The overhead reformer feedstream has a maximum endpoint of from about 204° to about 216° C. (400° to 420° F.), preferably about 196° C. (385° F.). The overhead reformer feedstream is withdrawn from fractionator 30 through line 32 and charged to reformer feed/effluent heat exchanger 40, which typically comprises two parallel banks of at least three shell and tube heat exchangers. The preheated hydrocracked reformer feedstream is withdrawn from heat exchanger 40 through line 42, mixed with hydrogen rich circulation gas from line 86 and is charged to the primary reformer process furnace 50 where it is heated to reforming reaction temperature. The heavy hydrocracker effluent bottom stream is withdrawn from fractionator 30 via line 34, and may be utilized in accordance with one or more of the following options. The bottom stream may be recycled to the hydrocracking reator vessel 18 by charging all or part of the bottom stream to line 10. Alternatively, the bottom stream may be returned to a diamondoid sorption facility as described below with reference to FIG. 2, or may be sold as a fuel oil.

The reforming stage of the present process is suitably carried out in three reactor vessels, designated in FIG. 1 as 60, 68, and 74. The initial reactions in the reforming process tend to be strongly endothermic, and temperatures within the first and second reactor vessels typically fall below the minimum reaction temperature near the bottom of the catalyst beds. For this reason, a reheat furnace 64 is provided for interstage heating between the first and second and the second and third reaction zones.

Effluent from the first reactor 60 is withdrawn through line 62 and reheated to reforming temperature in reheat furnace 64 before flowing through line 66 to reactor 68. The reactants are cooled by the endothermic reactions in reactor 68 and the cooled effluent is withdrawn through line 70 and charged back to reheat furnace 64. The reheated stream is then charged through line 72 to the third reactor 74. Depending on the feedstock composition and process conditions, the reactions proceeding in reactor 74 may be slightly endothermic, essentially heat balanced, or slightly exothermic. The raw reformate product is withdrawn from reactor 74 through line 76 and charged to reformer feed/effluent heat exchanger 40 as described above. The partially cooled product is transferred from heat exchanger 40 to heat exchanger 11 via line 48 to preheat the feedstock for the hydrocracking stage as described above. Cooled product then flows through line 52 to high pressure separator 54 where it is separated into an unstabilized reformate bottoms product flowing through line 56 and a hydrogen-rich circulation gas stream in line 58. To compensate for the system pressure drop, the hydrogen-rich circulation gas stream is repressurized in compressor 80 and flows through line 82 to lines 84 and 86. Hydrogen-rich circulation gas flow to the hydrocracking stage and the reforming stage is controlled by valves 85 and 87, respectively. Unstabilized reformate in line 56 may be debutanized in a product recovery fractionator (not shown) for use as stabilized reformate in gasoline blending.

Figure 2:
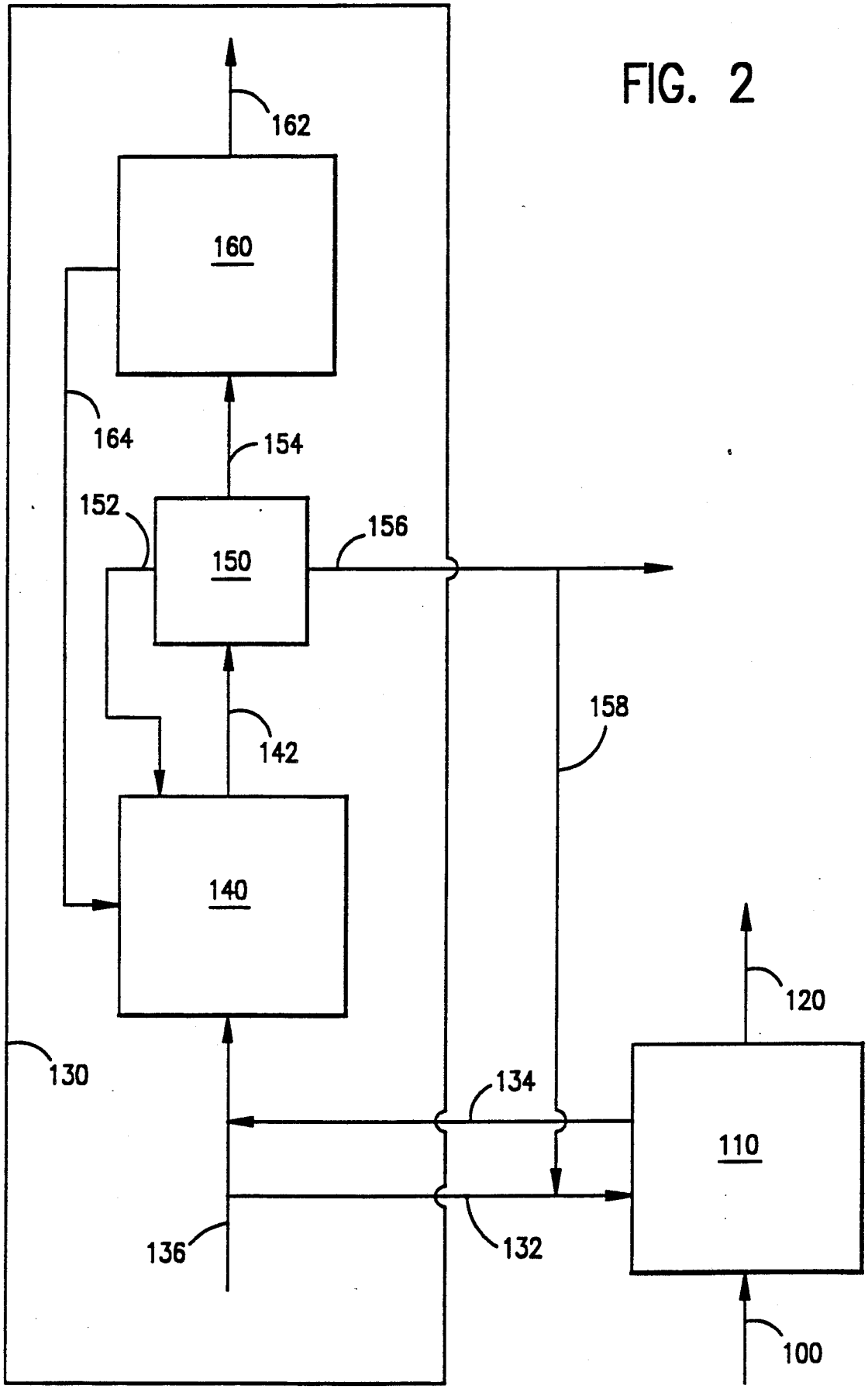
FIG. 2 is a simplified block diagram showing the integrated refining/natural gas production method of the invention.

Referring now to FIG. 2, the integrated refining/natural gas production method of the invention is described. Diamondoid-containing natural gas flows through line 100 and is contacted with a suitable liquid hydrocarbon solvent in contact zone 110. The purified natural gas is withdrawn from contact zone 110 via line 120 for further processing. This solvent contacting step may be carried out in a suitable vessel or may comprise the wellbore solvent injection technique as taught in allowed U.S. Pat. Application Ser. No. 405,119, filed Sept. 7, 1989, which is a continuation of U.S. Pat. No. 358,758, filed May 26, 1989, now abandoned, as well as allowed U.S. Pat. Applications Ser. Nos. 358,759; 358,760; and 358,761, all filed May 26, 1989. The texts of these allowed U.S. Pat. Applications are incorporated herein by reference. The diamondoid-containing solvent may optionally be concentrated as taught in the '759, '760 or '761 U.S. Patent applications, before further processing as described below.

In the integrated refining/natural gas production method of the invention, the solvent for dissolving the diamondoid compounds from the natural gas is withdrawn from a petroleum refinery complex, designated generally in FIG. 2 by reference numeral 130. The lean solvent may be continuously transferred from the refinery complex to the solvent contact zone 110 by a conduit 132. Alternatively, the solvent may be transported in batches to holding tankage near the solvent contact zone (not shown) and then continuously charged from the holding tankage to the solvent contact zone. Diamondoid-enriched solvent may be continuously returned to the petroleum refinery complex via conduit 134 or may be transferred in batches from holding tankage (not shown).

The solvent may comprise any hydrocracking feedstock boiling within the temperature ranges described above, for example, a distillate from a crude oil distillation tower, or a cracked product such as a cycle oil from a fluid catalytic cracking process. Thus a slipstream of hydrocracking process charge may be withdrawn from the hydrocracking process charge line 136 as shown, routed to the solvent contacting zone through line 132, and returned as diamondoid-enriched solvent to line 136 through line 134. The mixed solvent charge containing diamondoids sorbed from the natural gas stream then continues through line 136 and is charged to hydrocracking zone 140 where it is catalytically converted under hydrogen pressure to an intermediate product as described above. The intermediate product is withdrawn from the hydrocracking zone through line 142 and fractionated in separator 150. The overhead naphtha stream is charged through line 154 to the catalytic reforming zone 160 where it is converted to a motor gasoline blending stock which is withdrawn from the catalytic reforming zone through line 162. Hydrogen evolved in the reforming step is preferably compressed and recycled to the hydrocracking zone 140 via recycle line 164. The heavy hydrocracked product may be recycled to the contact zone 110 via line 158, recycled to the hydrocracking zone 140 through line 152, or withdrawn from the process cycle through line 156 to be sold as fuel oil.

EXAMPLE 1

A diesel fuel characterized as shown below in Table C was contacted with diamondoid-containing natural gas to evolve a liquid solution of diesel fuel and diamondoid compounds containing about 20 weight percent of diamondoid compounds. The composition of the diamondoid component as shown in Table D.

TABLE C

| COMPOSITION OF DIESEL FUEL SOLVENT BOILING POINT DISTRIBUTION, °F. | |
|---|---|
| 5% | 363 |
| 10% | 399 |
| 20% | 441 |
| 30% | 471 |
| 40% | 495 |
| 50% | 523 |
| 60% | 550 |
| 70% | 584 |
| 80% | 624 |
| 90% | 670 |
| 95% | 701 |
| HYDROCARBON TYPE DISTRIBUTION | |
| Aromatics | 46–58% |
| Paraffins | 22–29% |
| 1-ring naphthenes | 12–18% |
| 2-ring naphthenes | 5–6% |
| 3-ring naphthenes | 1–3% |
| Corrosion-inhibiting additives (Tritolite Brand) | |
| KP-111 | 0.8% Antifoam (carboxylic acid/polyamine) |
| KP-151 | 400 ppm Corrosion (thioalkyl substituted) Inhibitor (phenolic heterocycle) |

TABLE D

| DIAMONDOID DISTRIBUTION IN ENRICHED DIESEL FUEL SOLVENT | | |
|---|---|---|
| Compound | % Abundance | Boiling Pt, °F. |
| Adamantane | 12.7 | 386 |
| 1-Methyladamantane | 31.3 | 394 |
| 1,3-Dimethyladamantane | 20.8 | 400 |
| 1,3,5-Trimethyladamantane | 5.1 | 403 |
| 2-Methyladamantane | 1.3 | 415 |
| 1-Ethyl-3-Methyladamantane | 1.2 | 443 |
| Diamantane | 8.5 | 529 |
| 4-Methyldiamantane | 6.1 | 534 |
| 1-Methyldiamantane | 2.8 | 545 |
| Trimantane | 1.2 | 647 |
| 1-Methyltrimantane | 1.0 | 648 |
| Other Diamondoids | 8.0 | |

The diamondoid-containing diesel fuel solution was charged to an 8 mm diameter tubular reactor packed with 4.4 grams of a commercial sulfided Ni-Mo-alumina hydrotreating (HDT) catalyst followed by 3.5 grams of a composite catalyst containing 65 weight % zeolite Y composited in an alumina binder. The hydrocracking conversion conditions included hydrogen partial pressure of 6972 kPa (1000 psig), and temperature of from about 400° to 420° C. Weight hourly space velocities varied from about 0.8 to about 1.3 $hr^{-1}$. Hydrogen consumption was estimated at about 1200 SCF/B at 60 weight % conversion. The analysis of the hydrocracked product is shown in Table E.

TABLE E

| | FEED | HYDROTREATED/ HYDROCRACKED PRODUCT | | |
|---|---|---|---|---|
| Reactor Temp, °F. | — | 757 | 753 | 789 |
| LHSV, $hr^{-1}$ | — | 1.3 | 1.1 | 0.8 |
| Conversion to naphtha boiling below 385° F., wt. % | — | 52.1 | 74.5 | 97.9 |
| Naphtha Yield, wt. % | 15.0 | 49.6 | 64.9 | 59.6 |
| Diamondoids, wt. % | ~12 | ~4.8 | ~2.4 | ~0.24 |

The intermediate hydrocracked product is suitable for further upgrading to a motor gasoline blending stock via reforming as shown in Example 2.

EXAMPLE 2

The intermediate hydrocracked product of Example 1 is then charged to a tubular reactor containing 10 grams of a composite Pt-Re catalyst containing about 0.6 weight percent combined metals on an alumina support. Process conditions include hydrogen partial pressure of 1132 kPa (150 psig), temperature of 510° C. and weight hourly space velocity of 1.5 $hr^{-1}$ based on liquid feed. Approximately 2.5 mols of hydrogen are evolved per mol of liquid feed.

This Example demonstrates that a large-pore zeolite can effect selective hydrocracking of the otherwise refractory diamondoid molecules to an intermediate product which is readily upgraded to a saleable motor gasoline blending stock.

Changes and modifications in the specifically described embodiments can be carried out without departing from the scope of the invention which is intended to be limited only by the scope of the appended claims.

We claim:

1. An integrated method for upgrading a diamondoid-containing hydrocarbon solvent comprising the steps of:

(a) providing a hydrocrackable hydrocarbon solvent mixture having dissolved therein at least one diamondoid compound selected from the group consisting of adamantane, alkyl-substituted adamantane, diamantane, alkyl-substituted diamantane, triamantane, and alkyl-substituted triamantane;

(b) hydrocracking said hydrocarbon solvent mixture of step (a) over a hydrocracking catalyst under controlled hydrocracking conditions including hydrogen pressure selected to convert at least a portion of diamondoid compounds contained therein to alkyl substituted cyclohexanes;

(c) withdrawing a hydrocracked intermediate product from said primary reaction zone of step (b);

(d) reforming at least a portion of said hydrocracked intermediate product over a reforming catalyst comprising a Group VIIIA metal under reforming conditions selected to evolve molecular hydrogen and to convert at least a portion of said alkyl substituted cyclohexane to substituted aromatics;

(e) recycling a first portion of said molecular hydrogen produced in said secondary reaction zone of step (d) to said primary reaction zone of step (b); and (f) recycling a second portion of said molecular hydrogen to said secondary reaction zone of step (d) to maintain the hydrogen partial pressure required for reforming said hydrocracked intermediate product to motor gasoline blending stock.

2. The process of claim 1 further comprising controlling the severity of said reforming conditions of step (d) to evolve an excess of molecular hydrogen over the quantity consumed in said hydrocracking step (b).

3. The process of claim 1 further comprising regulating said hydrocracking and said reforming process conditions to balance hydrogen consumption in hydrocracking step (b) with hydrogen evolution in said reforming step (d).

4. The process of claim 1 wherein said hydrocracking catalyst comprises a zeolite having a Constraint Index of less than about 1.

5. The process of claim 4 wherein said hydrocracking catalyst has the structure of at least one selected from the group consisting of zeolite X, zeolite Y, zeolite REX, zeolite REY, zeolite USY, ZSM-3, ZSM-20, zeolite Beta and mordenite.

6. The process of claim 1 wherein said reforming catalyst comprises at least one Group VIIIA metal on a support.

7. The process of claim 6 wherein said Group VIIIA metal is at least one selected from the group consisting of Pt, Pd, Co, Ni, Ir and Rh.

8. The process of claim 6 wherein said reforming catalyst further comprises at least 2 Group VIIIA metals.

9. The process of claim 6 wherein said reforming catalyst further comprises a Group VIIA metal.

10. A method for disposing of a liquid hazardous waste material comprising the steps of:

(a) providing a hydrocarbon waste stream containing at least one diamondoid compound;

(b) hydrocracking said diamondoid-containing hydrocarbon waste stream to convert said diamondoid compound to an intermediate product stream suitable for upgrading over a reforming catalyst;

(c) reforming said intermediate product stream to a raw reformate product whereby hydrogen is evolved; and (d) recycling hydrogen from said reforming step (c) to said hydrocracking step (b).

11. The process of claim 10 further comprising debutanizing said raw reformate product to form a gasoline blending stock enriched in $C_5+$ branched paraffins and aromatics.

12. A method for removing diamondoid compounds from a hydrocarbon gas stream containing said diamondoid compounds comprising the steps of:

(a) providing a hydrocrackable refinery stream in which the diamondoid compounds dissolved in said hydrocarbon gas stream are at least partially soluble;

(b) contacting said hydrocrackable refinery stream with said hydrocarbon gas stream to dissolve diamondoid compounds in said hydrocrackable refinery stream;

(c) catalytically hydrocracking said diamondoid-containing hydrocrackable refinery stream of step (b) under hydrogen pressure to evolve an intermediate product suitable for catalytic reforming; and (d) catalytically reforming said intermediate product of step (c) to a final product stream enriched in motor gasoline blending components.

13. The process of claim 12 further comprising controlling the severity of said reforming conditions of step (d) to evolve an excess of molecular hydrogen over the quantity consumed in said hydrocracking step (c).

14. The process of claim 12 further comprising regulating said hydrocracking and said reforming process conditions to balance hydrogen consumption in hydrocracking step (c) with hydrogen evolution in said reforming step (d).

15. The process of claim 12 wherein said hydrocracking catalyst comprises a zeolite having a Constraint Index of less than about 1.

16. The process of claim 15 wherein said hydrocracking catalyst has the structure of at least one selected from the group consisting of zeolite X, zeolite Y, zeolite REX, zeolite REY, zeolite USY, ZSM-3, ZSM-20, zeolite Beta and mordenite.

17. The process of claim 12 wherein said reforming catalyst comprises at least one Group VIIIA metal on a support.

18. The process of claim 17 wherein said Group VIIIA metal is at least one selected from the group consisting of Pt, Pd, Co, Ni, Ir and Rh.

19. The process of claim 17 wherein said reforming catalyst further comprises a Group IVA metal.

20. The process of claim 17 wherein said reforming catalyst further comprises a Group VIIA metal.

21. An integrated method for upgrading a diamondoid-containing hydrocarbon solvent comprising the steps of:

(a) providing a hydrocarbon solvent mixture containing normal or slightly branched paraffins having dissolved therein at least one diamondoid compound selected from the group consisting of adamantane, alkyl-substituted adamantane, diamantane, alkyl-substituted diamantane, triamantane, and alkyl-substituted triamantane;

(b) hydrocracking said hydrocarbon solvent mixture of step (a) over a hydrocracking catalyst under controlled hydrocracking conditions including hydrogen pressure selected to convert at least a portion of diamondoid compounds contained therein to alkyl substituted cyclohexanes, including 1,3,5,-alkyl substituted cyclohexanes;

(c) withdrawing a hydrocracked intermediate product from said primary reaction zone of step (b);

(d) reforming said hydrocracked intermediate product over a reforming catalyst comprising a Group VIIIA metal under reforming conditions selected to evolve molecular hydrogen and to convert at least a portion of said alkyl substituted cyclohexane to substituted aromatics;

(e) recycling a first portion of said molecular hydrogen produced in said secondary reaction zone of step (d) to said primary reaction zone of step (b); and (f) recycling a second portion of said molecular hydrogen to said secondary reaction zone of step (d) to maintain the hydrogen partial pressure required for reforming said hydrocracked intermediate product to motor gasoline blending stock.

* * * * *